US007736186B2

(12) United States Patent
Li et al.

(10) Patent No.: US 7,736,186 B2
(45) Date of Patent: Jun. 15, 2010

(54) CABLE CONNECTOR ASSEMBLY WITH IMPROVED HOUSING WITH ARMS

(75) Inventors: Chang-Mao Li, KunShan (CN); Hou-Yu Shi, KunShan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/586,139

(22) Filed: Sep. 16, 2009

(65) Prior Publication Data

US 2010/0068934 A1 Mar. 18, 2010

(30) Foreign Application Priority Data

Sep. 16, 2008 (CN) ..... 2008 2 0302146 U

(51) Int. Cl.
*H01R 9/03* (2006.01)

(52) U.S. Cl. ..... 439/607.55; 439/607.58

(58) Field of Classification Search ..... 439/607.54–607.58

See application file for complete search history.

(56) References Cited

U.S. PATENT DOCUMENTS

| | | | | |
|---|---|---|---|---|
| 7,357,679 | B2 * | 4/2008 | Wang | 439/660 |
| 7,384,306 | B2 * | 6/2008 | Malstrom et al. | 439/578 |
| 7,494,384 | B2 * | 2/2009 | Friedhof | 439/701 |

* cited by examiner

*Primary Examiner*—Khiem Nguyen
(74) *Attorney, Agent, or Firm*—Wei Te Chung; Andrew C. Cheng; Ming Chieh Chang

(57) ABSTRACT

A cable connector assembly (100) includes an insulated housing (2), a plurality of contacts (3) received in the insulated housing, a spacer (4) assembled to the insulated housing and a metallic shell (1) enclosing the insulated housing. The insulated housing (2) comprises a main portion (21) and two arms (22) extending from both sides of the main portion backwards, and at least one of the two arms defines a latching hole (2213), the spacer has a projecting portion (4203) locked with the latching hole (2213) in the arm.

11 Claims, 7 Drawing Sheets

CABLE CONNECTOR ASSEMBLY WITH IMPROVED HOUSING WITH ARMS

BACKGROUND OF THE INVENTION

1. Field of the Invention

The present invention generally relates to a cable connector assembly, and more particularly to a cable connector assembly transmitting high-speed audio and video signals.

2. Description of Related Art

Many electronic devices rely upon transmission lines to transmit signals between related devices or between peripheral devices and circuit boards of a computer. These transmission lines incorporate signal cables that are capable of high-speed data transmissions.

At present, HDMI connector is widely used for transmitting signals between a TV and other peripheral device. As the development of the digital technology, a lot of related electronic products are come out, and type of high definition multimedia interfaces of the electronic products also becomes more and more, to adapt requirements of the LCD panel. CN patent No. 200959371Y issued to Su on Oct. 10, 2007 discloses a cable connector assembly, the cable connector assembly comprises an insulated housing, a spacer with contacts, a top shell and a bottom shell, the spacer is assembled to a cavity of the insulated housing, however, the spacer may move relative to the insulated housing as there's no locking mechanism therebetween, and the insulated housing with no fixing structure to the top and bottom shell.

Correspondingly, it is desired to have a cable connector assembly with improved cable arrangement and convenient assembly to address the problems stated above.

BRIEF SUMMARY OF THE INVENTION

Accordingly, an object of the present invention is to provide a cable connector assembly having an improved insulated housing to prevent separating from a spacer.

In order to achieve the above-mentioned object, a cable connector assembly in accordance with the present invention comprises an insulated housing, a plurality of contacts received in the insulated housing, a spacer assembled to the insulated housing and a metallic shell enclosing the insulated housing. The insulated housing comprises a main portion and two arms extending from both sides of the main portion backwards, and at least one of the two arms defines a latching hole, the spacer has a projecting portion locked with the latching hole in the arm.

Other objects, advantages and novel features of the invention will become more apparent from the following detailed description of the present embodiment when taken in conjunction with the accompanying drawings.

DETAILED DESCRIPTION OF THE INVENTION

Figure 1:
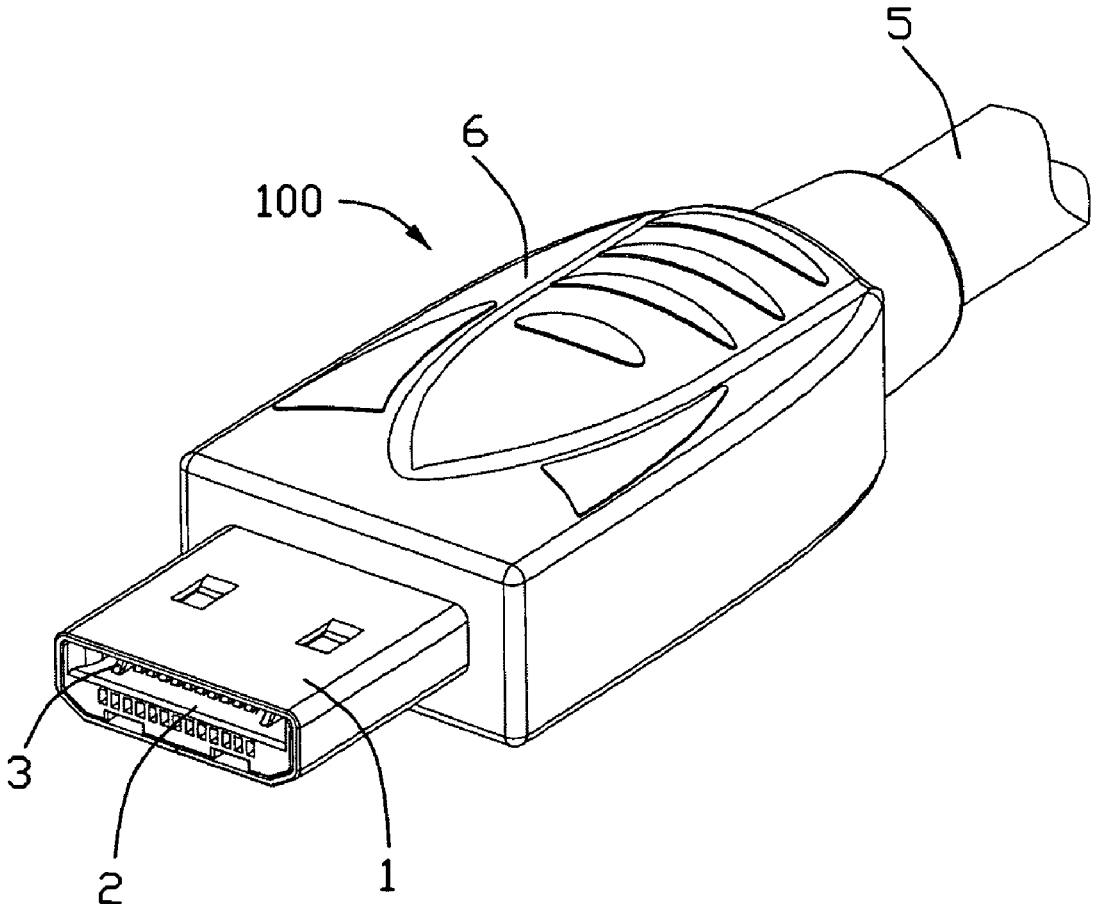
FIG. 1 is an assembled, perspective view of a cable connector assembly.

Reference will now be made to the drawing figures to describe the present invention in detail.

Figure 2:
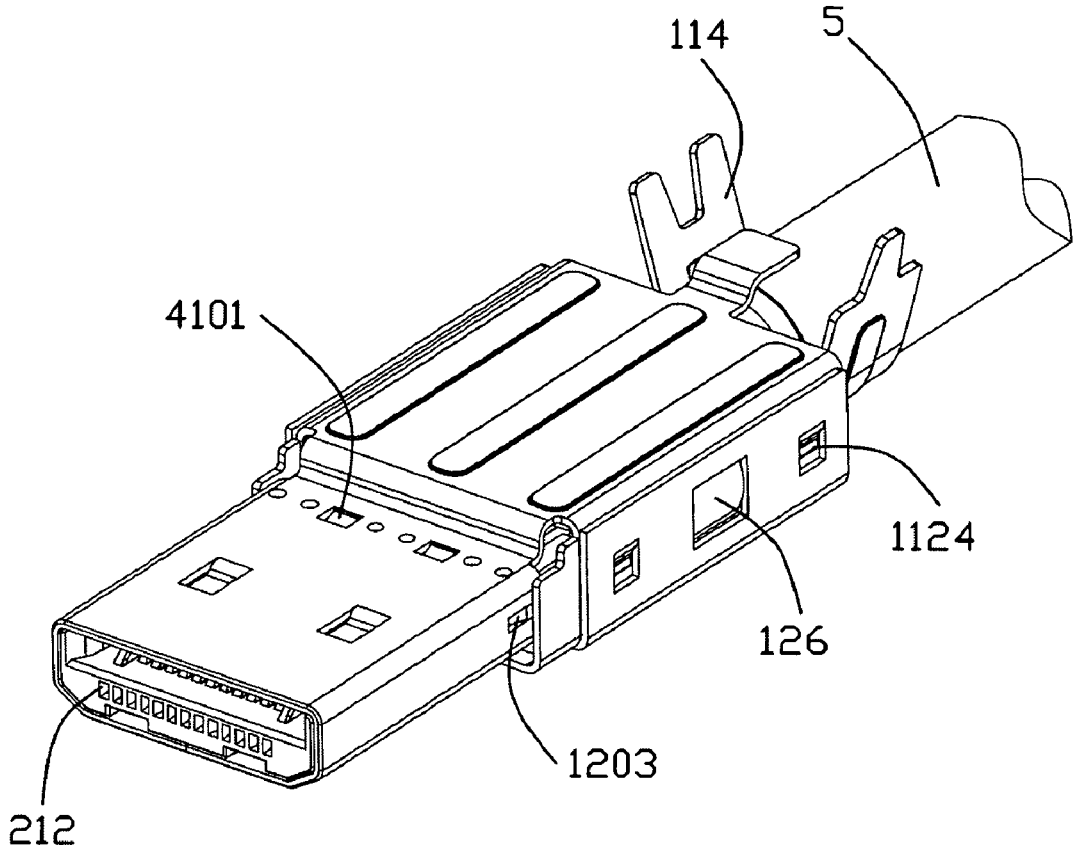
FIG. 2 is an assembled, perspective view of the cable connector assembly with an insulated cover thereof removed.
Figure 3:
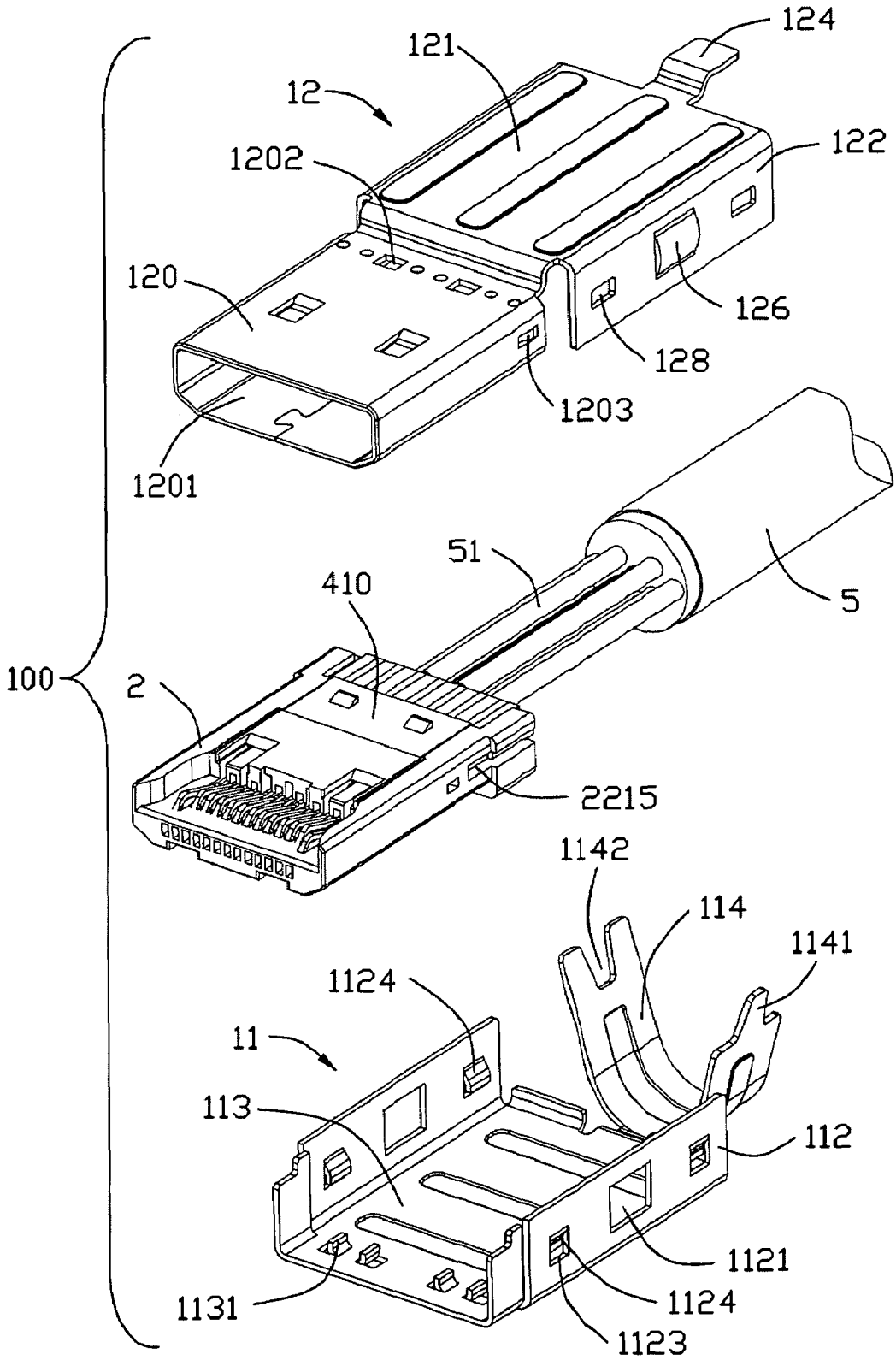
FIG. 3 is a partially assembled view of the cable connector assembly.
Figure 4:
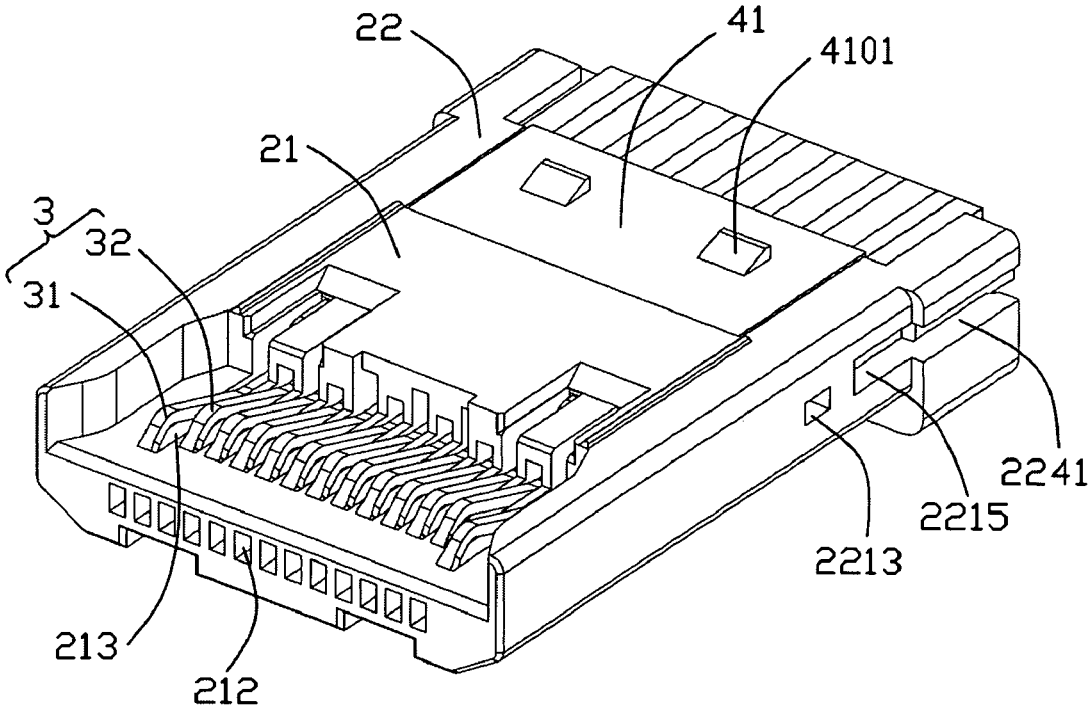
FIG. 4 is another partially assembled, perspective view of the cable connector assembly.
Figure 5:
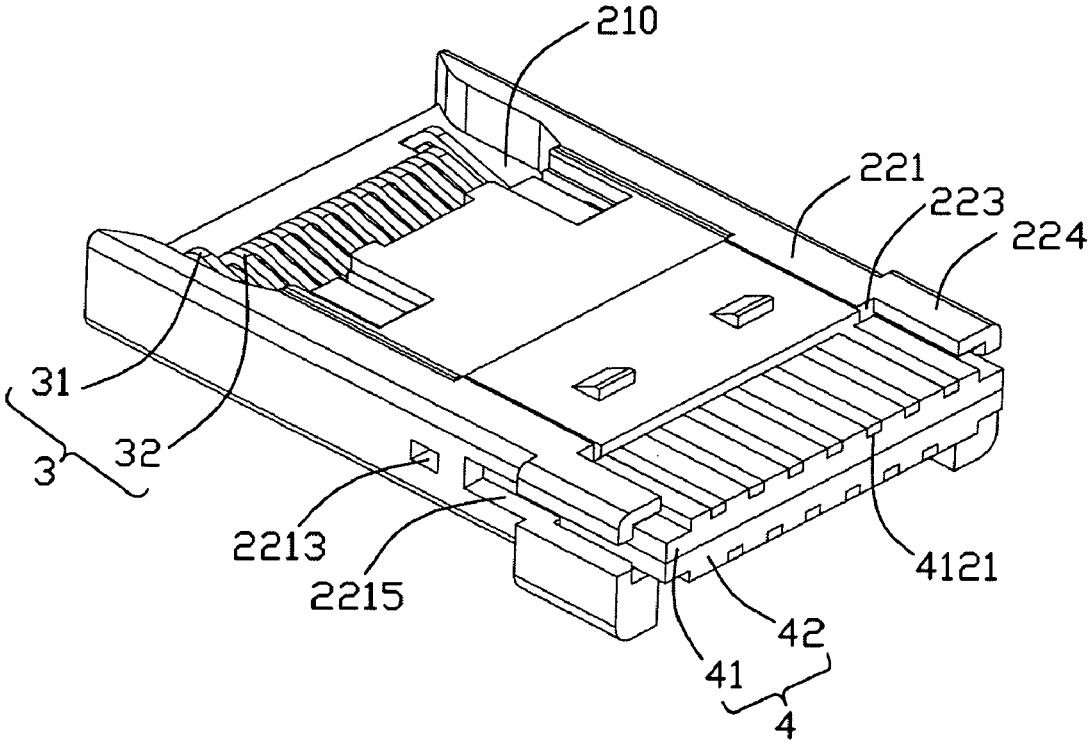
FIG. 5 is similar to FIG. 4, but viewed from another aspect.
Figure 6:
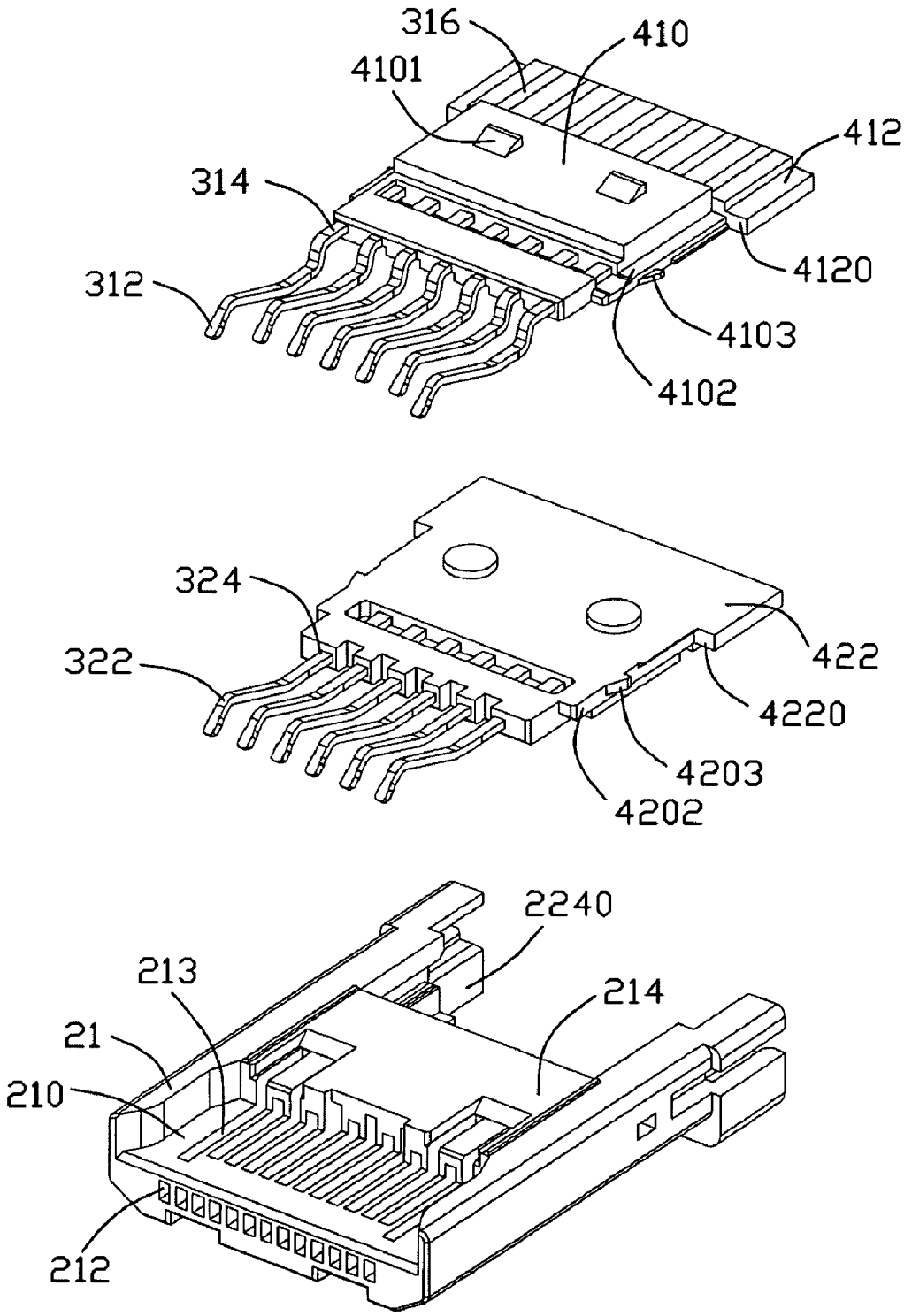
FIG. 6 is an exploded, perspective view of the cable connector assembly showed in FIG. 4.

Referring to FIGS. 1-3, a cable connector assembly 100 in accordance with the present invention comprises a metallic shell 1, an insulated housing 2, a plurality of contacts 3 housed in the insulative housing 2, a pair of spacers 4 integrally molded with corresponding contacts 3, a cable 5 with a plurality of wires 51, and a cover 6 over-molded with the insulated housing 2. The cable connector assembly 100 is designed in accordance with Digital Interactive Interface for Video & Audio (DiiVA) standard.

Referring to FIGS. 2-3, the metallic shell 1 includes a bottom shielding member 11 and a top shielding member 12. The bottom shielding member 11 is of inverted U-shaped, and has a pair of first side walls 112 and a bottom wall 113 interconnected with the first side walls 112. A receiving hole 1121 is defined in middle of each first side wall 112, a pair of openings 1123 are disposed on both sides of the receiving holes 1121. A tab 1124 is extended from upper side of each opening 1123 and towards interior, a plurality of projections 1131 are bent from the bottom wall 113 and located on front end of the bottom wall 113, two projections 113 adjacent to each other are formed an opposite group. A cable holder portion 114 is coupled to a back edge of the bottom wall 113, the cable holder portion 114 defines a salient 1141 and an engaging cutout 1142 matching with the salient 1141.

The top shielding member 12 comprises a rectangular sleeve portion 120 with a cavity 1201 and a U-shaped extension portion 121 extending from a back edge of the sleeve portion 120, a flake 124 is extending from a back end of the extension portion 121 upwards firstly and then horizontally. A pair of second side walls 122 are extending downwards from lateral sides of the extension portion 121, each second side wall 122 defines a protrusion 126 and a pair of openings 128 located on both sides of the protrusion 126. The sleeve portion 120 defines a pair of locking portion 1202 in an upper surface thereof and neighboring to the extension portion 121. A pair of blocks 1203 extending entad from a rear portion of the sleeve portion 120 are respectively arranged at opposite sides thereof.

Referring to FIGS. 3-7, the insulated housing 2 comprises a main portion 21 and two arms 22 extending rearward from lateral sides of a back face of the main portion 21. A sunken portion 210 is recessed downwardly from a top surface of a front segment of the main portion 20. A plurality of receiving channels 212 are defined through the main portion 21 of the insulated housing 2 along a front-to-back direction, the main portion 21 has a number of passages 213 communicated with corresponding receiving channels 212. The main portion 21 has a first plate 214 and a second plate 215 spaced from the first plate 214 to form a receiving space 216 opening toward rearwards. The arms 22 are opposite to each other, each arm 22 comprises a first extending section 221 and a second extending section 224 extending backwards and outwards from the first extending section 221, and a stopper 223 is formed at a rear end of each first extending section 221. A guiding groove 2241 is recessed outwards from an inner side of each second extending section 224, the guiding groove 2241 penetrates through the second section 224 along a transverse direction with the inner part higher than the outer part. A leading slot 2211 is formed in each first extending section 221 and communicated with the receiving space 216 of the main portion 21, an inner wall 2210 of the leading slot 2211 is coplanar to an inside surface 2240 of the second extending section 224. A latching hole 2213 neighboring to the main portion 21 is defined through each arm 22 along the transverse direction, a notch 2215 located behind the latching hole 2213 is recessed forwardly from a back face of the second extending section 224 and communicated with the guiding groove 2241.

The contacts 3 include a group of first contacts 31 and a group of second contacts 32, the first contacts 31 and the second contacts 32 are insert-molded in a first spacer 41 and a second spacer 42 respectively, to form a first contact module and a second contact module. Each first contact 31 has a retention portion 314, a mating portion 312 extending forward from a front portion of the retention portion 314 and a tail portion 316 extending rearward from a back portion of the retention portion 314, the mating portion 312 is bending from the retention portion 314 firstly, then extending forward and upwardly, and finally downwards. The two first contacts 31 located at opposite sides have longer mating portions 312 than the others. The second contacts 32 have the same configurations as the first contacts 31, and each second contact 32 comprises a retention portion 324, a mating portion 322 extending forward and a tail portion (not numbered) extending rearward. The mating portion 322 of the second contact 32 is different from the mating portion 312 of the first contact 31, and the mating portion 322 is extending horizontally from the retention portion 324 firstly, then extending forwards slantways, and finally turning downwards.

The spacer 4 comprises the first spacer 41 and the second spacer 42, and the first spacer 41 has a base portion 410 over-molded out of the retention portions 314 of the first contacts 31, and an enlarged portion 412 expanded from a back end of the base portion 410 outwards. A pair of tubers 4101 is arranged on an upper surface of the base portion 410 and combined with corresponding locking portions 1202 of the top shielding member 12. The enlarged portion 412 defines a pair of stopping portions 4120 at lateral sides and a number of receiving slots 4121 accommodating the tail portions 316 of the first contacts 31. Two flanges 4102 are respectively formed at lateral sides of the base portion 410. Each flange 4102 has a projecting portion 4103 extending from thereof outwards. The second spacer 42 is opposite to the first spacer 41 and has the same configuration with the first spacer 42 in the rough. The second spacer 42 also has a base portion 420 and an enlarged portion 422, the base portion 420 defines a pair of flanges 4202 with a projecting portion 4203 thereon, the enlarged portion 422 has a pair of stopping portions 4220 located on the same vertical plane as corresponding stopping portion 4120 of the first spacer 41. A plurality of receiving slots (not numbered) accommodating the second contacts 32 are arranged on a lower surface of the enlarged portion 422, the second spacer 42 has a pair of short posts 425 on an upper surface thereof, the posts 425 are housed in corresponding holes (not shown) in a lower surface of the first spacer 41 to connect the first spacer 41 with the second spacer 42.

Figure 7:
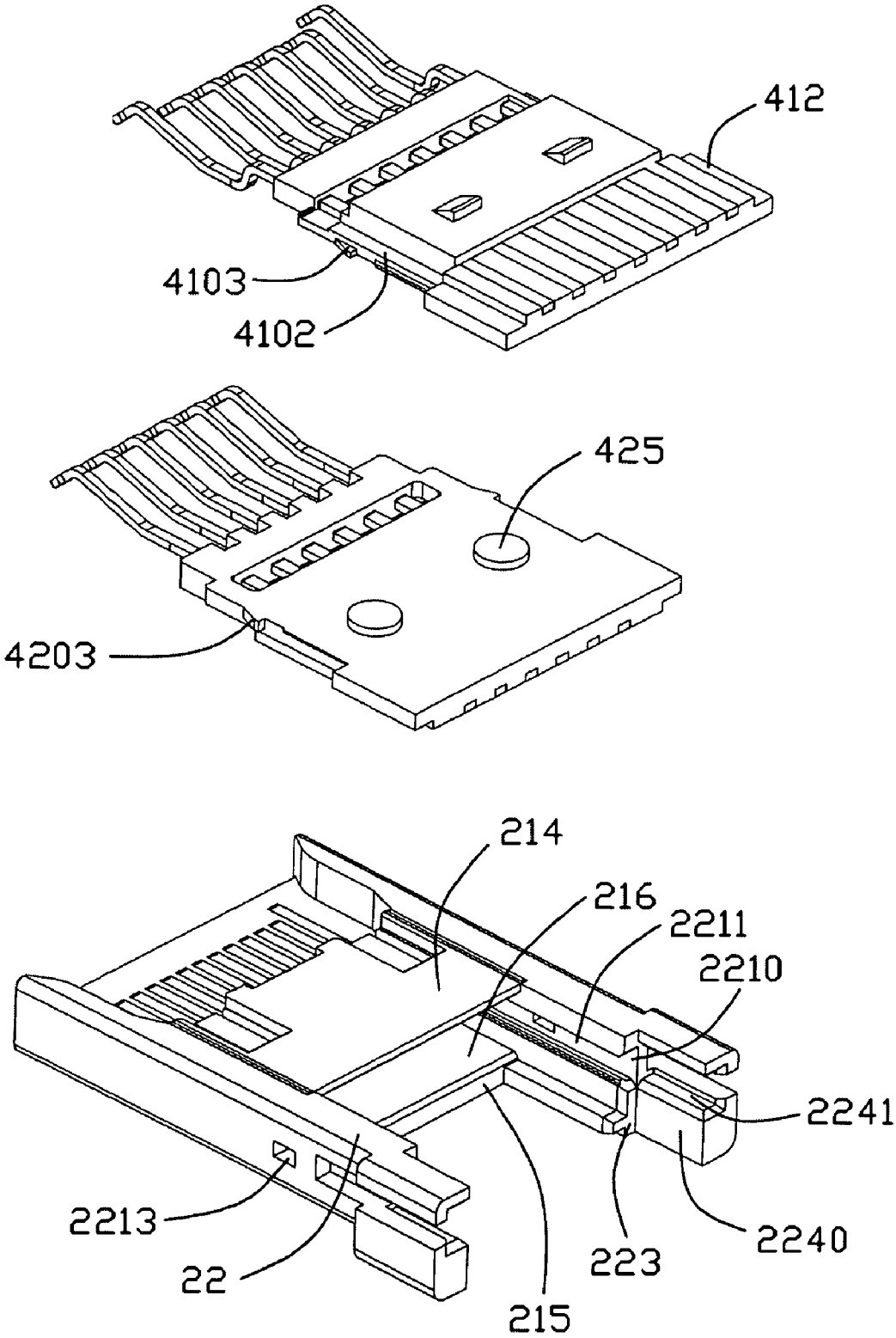
FIG. 7 is similar to FIG. 6, but viewed from another aspect.

Referring to FIGS. 2-3 and FIG. 7, in assembly, the second spacer 42 molded with the second contacts 32 is assembled to the first spacer 41 molded with the first contacts 31 along the up-to-down direction, the mating portions 312, 322 of contacts 3 are disposed in juxtaposed and stagger manner, the first contacts 31 with longer mating portion 312 are located out of the other contacts 3 including the second contacts 32. The first contact module and the second contact module are mounted into the insulated housing 2 along the back-to-front direction, with the flanges 4102, 4202 of the first spacer 41 and second spacer 42 sliding along the guiding grooves 2241 to the leading slots 2211, the front part of the spacer 4 is accommodated in the receiving space 216, the mating portions 312, 322 of the contacts 3 are inserted into the receiving channels 212 of the insulated housing 2, and the top ends of the mating portions 312, 322 are exposed out of the passages 213. The first spacer 41 and the second spacer 42 move forward until the stopping portions 4120, 4220 of the enlarged portions 412, 422 adjacent to the stopper 223. The projecting portions 4203 are locked in the latching holes 2213 to prevent the first contact module moving relative to the second contact module.

Then the wires 51 of the cable 5 are soldered to the tail portions of the contacts 3, the components mentioned before are assembled to the top shielding member 12, the tubers 4101 are protruding upwardly into the locking portions 1202, and the blocks 1203 are latched in the notch 2215 of the insulated housing 2. The bottom shielding member 11 is assembled to the extension portion 121 of the top shielding member 12 to protect the electrical conjunction. The protrusions 126 of the top shielding member 12 are located in the receiving holes 1121 of the bottom shielding member 11, the tabs 1124 are locked in the openings 128 of the top shielding member 12, the cable 5 is disposed and enclosed in the cable holder portion 114, and a cover 6 is over-molded with the components mentioned before partially.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising: an insulated housing comprising a main portion and two arms extending from both sides of the main portion backwards, at least one of the two arms defining a latching hole; a plurality of contacts received in the insulated housing; a spacer assembled to the insulated housing, the spacer having a projecting portion locked with the latching hole in the arm; and a metallic shell enclosing the insulated housing, wherein the main portion has a receiving space to accommodate a front part of the spacer, wherein the contacts are insert-molded in the spacer, wherein the spacer comprises a first spacer and a second spacer, and the contacts comprise a group of first contacts and a group of second contacts molded in the first and second spacers respectively.

2. The cable connector assembly as claimed in claim 1, wherein the arm defines a guiding groove recessed from a back end thereof, and a flange is disposed on a lateral side of the spacer and sliding along the guiding groove.

3. The cable connector assembly as claimed in claim 2, wherein the projecting portion is defined on an outer side of the flange.

4. The cable connector assembly as claimed in claim 1, wherein the spacer defines a tuber on an upper surface thereof, and the metallic shell has a locking portion combined with the tuber.

5. The cable connector assembly as claimed in claim 1, wherein the arm defines a stopper located in a middle thereof, the spacer extends to form an enlarged portion outwards, and the enlarged portion has a stopping portion adjacent to the stopper.

6. The cable connector assembly as claimed in claim 5, wherein the arm comprises a first extending section and a second extending section extending backwards and outwards from the first extending section, and the stopper is located between the first extending section and the second section.

7. The cable connector assembly as claimed in claim 1, wherein the second spacer defines a post on an upper surface thereof, and the first spacer has a hole in a lower surface thereof to receive the post.

8. The cable connector assembly as claimed in claim 7, wherein the metallic shell includes a bottom shielding member and a top shielding member defining a block received in a notch of the insulated housing.

9. The cable connector assembly as claimed in claim 8, wherein the bottom shielding member has a pair of first side walls, and each first side wall defines a receiving hole and a pair of tabs located on lateral sides of the receiving hole.

10. The cable connector assembly as claimed in claim 9, wherein the top shielding member has a pair of second side walls with a protrusion located in the receiving hole and a pair of openings locked with the tabs.

11. A cable connector assembly comprising: an insulative housing defining a row of passageways each extending along a front-to-back direction, and a front mating port communicating with said passageways; and first and second terminal modules stacked with each other in a vertical direction perpendicular to said front-to-back direction, each of said terminal modules integrally equipped with plural embedded contacts in one row, each of said contacts defining a front mating section; wherein the mating sections of the contacts of the first terminal module and those of the second terminal module are alternately arranged with each other in said passageways, respectively, wherein said first terminal module and said second terminal module have interengagement devices to restrain a relative horizontal movement therebetween, wherein at least one of said first terminal module and said second terminal module is equipped with a latch locked to an aperture in the housing.

* * * * *